US011584499B2

(12) United States Patent
Wathey

(10) Patent No.: US 11,584,499 B2
(45) Date of Patent: Feb. 21, 2023

(54) INTEGRAL PERSONAL WATERCRAFT SHAFT SEALING AXIAL ALIGNMENT SYSTEMS

(71) Applicant: Chad Wathey, Cole Bay (SX)

(72) Inventor: Chad Wathey, Cole Bay (SX)

( * ) Notice: Subject to any disclaimer, the term of this patent is extended or adjusted under 35 U.S.C. 154(b) by 0 days.

(21) Appl. No.: 17/402,504

(22) Filed: Aug. 14, 2021

(65) Prior Publication Data

US 2021/0371077 A1 Dec. 2, 2021

(51) Int. Cl.
*B63H 23/32* (2006.01)

(52) U.S. Cl.
CPC ..... *B63H 23/321* (2013.01)

(58) Field of Classification Search
CPC ..... B63H 23/00; B63H 23/32; B63H 23/321; B63H 23/326; B63H 2023/322; B63H 2023/323; B63H 2023/325; B63H 2023/327; B63H 2020/025; F16J 15/00; F16J 15/16; F16J 15/50; F16J 15/52; F16J 15/3268; F16J 15/3272; F16J 15/3276; F16J 15/54
USPC ..... 277/543
See application file for complete search history.

(56) References Cited

U.S. PATENT DOCUMENTS 6,524,151 B1 * 2/2003 Clemente ..... B63H 23/321 440/112
2003/0173744 A1 * 9/2003 MacDonald ..... F16J 15/3276 277/394
2014/0346738 A1 * 11/2014 Rusch ..... F16J 15/004 29/401.1

* cited by examiner

*Primary Examiner* — Nathan Cumar

(57) ABSTRACT

A clamping mechanism is provided. The mechanism includes a male clamping body. The mechanism also includes a female clamping body configured to mate with the male clamping body. The mechanism further includes tightening bolts structured to connect the male clamping body to the female clamping body. The mechanism includes connecting spans connected to the male clamping body and the female clamping body. The mechanism also includes integral positioning ring halves connected to the male clamping body and the female clamping body, wherein the positioning rings are designed to fit into a positioning groove of a drive shaft and to provide a backstop to a support ring. Also, the connecting spans, the male clamping body, and the female clamping body have inner diameters that are identical and are arranged to securely fit onto an outer surface of the drive shaft when the tightening bolts are tightened.

10 Claims, 7 Drawing Sheets

INTEGRAL PERSONAL WATERCRAFT SHAFT SEALING AXIAL ALIGNMENT SYSTEMS

FIELD OF THE INVENTION

The present invention relates generally to shaft sealing systems, and more particularly, to integral personal watercraft shaft sealing axial alignment systems which provide the ability to secure the components of a shaft sealing system with redundancy.

BACKGROUND OF THE INVENTION

Many methods and systems have been used in unsuccessful attempts to provide mechanisms to provide an efficient, effective, and inexpensive way to provide redundancy to shaft sealing components. These systems and methods have not been reliable or effective. Many of the unsuccessful systems are cumbersome, costly and fail to provide all of the necessary material and physical features on a singular platform.

Current attempts include utilization of a single loose approximately 180 degree C-clip with a curvature radius slightly smaller than the radius of the drive shaft groove. The drive shaft has a predetermined groove to align axially where the drive shaft support ring is to be positioned during operation. After placement of the C-clip within the groove, the drive shaft support ring, having a groove on an inner surface, aligns with the C-clip and slides into place. Therefore, when the C-clip has been snapped into place onto the groove on the drive shaft and then the support ring inner grove slides into place over the C-clip, this provides the mechanism to keep the support ring in place on the shaft during high RPM operations. This arrangement is problematic in that it doesn't offer redundancy in securing the axial position of the support ring to the shaft and is also problematic because the C-clip does not fully encompass the entire circumferences of both the shaft and the support ring. This causes issues after prolonged use and causes premature wear and vibration.

Further, because of the saltwater environment in which most of the personal watercraft operate in, the current C-clip configuration may be subjected to functional failure due to corrosion. This functional failure due to corrosion can occur rather quickly.

Also, the preexisting systems are subject to frictional wear because of minimal contact area between the C-clip, the grooves on the drive shaft and under the support ring. This is exacerbated because of the minimal contact area allow for movement during operation can causes material due to relative movement. Friction erosion is also a problem for this set up.

In the preexisting systems the C-clip just does hold in place the components and is often ejected from its specified position.

Accordingly, there is an established need for an integral personal watercraft shaft sealing system which solves at least one of the aforementioned problems. Further, there is an established need for an integral personal watercraft shaft sealing system which can address providing redundant positioning of the components of the shaft sealing system and to prevent c-clip ejection.

SUMMARY OF THE INVENTION

According to an aspect of the present invention, integral personal watercraft shaft sealing axial alignment systems are provided. These innovations include new, useful, and non-obvious systems which provide a user of the system redundant shaft sealing system component positioning and securing for increased protection from premature friction wear from relative movement and vibrational failure.

According to another aspect of the present invention, the system can include an integral shaft component positioning integral clamping mechanism. The integral clamping mechanism includes two mating semicircular clamping mechanism halves such that when they are placed around the exterior of the drive shaft, the integral positioning ring is snapped into the groove on the drive shaft, the two tightening bolts join the male and female halves of the clamping mechanism, the system provides a 360-degree integral positioning ring surface wherein the support ring's inner groove can be aligned by abutting the upper outer radial surface of the integral positioning ring. Further, once the integral clamping mechanism is tightened onto the exterior of the shaft and the integral positioning ring is in place, the system provides for enhanced resistance against movement because of the enhanced surface area engagement between the inner surfaces of the system and the exterior of the shaft and the 360-degree engagement of the surface of the integral positioning ring with both the drive shaft and the support ring.

According to yet another aspect, a clamping mechanism suitable for use as an integral personal watercraft shaft sealing axial alignment system is provided. The mechanism includes a male clamping body. The mechanism also includes a female clamping body configured to mate with the male clamping body. The mechanism further includes tightening bolts structured to connect the male clamping body to the female clamping body. The mechanism includes connecting spans connected to the male clamping body and the female clamping body. The mechanism also includes integral positioning ring halves connected to the male clamping body and the female clamping body with the connecting spans, wherein the integral ring halves form a circular toroid when the male clamping body and the female clamping body are connected and assembled and wherein the radius of the toroid circular cross section is designed to fit into a positioning groove of a drive shaft and to provide axial positioning for shaft sealing components by acting as a backstop to a support ring. Further the connecting spans, the male clamping body, and the female clamping body have inner diameters that are identical and are arranged to securely fit onto an outer surface of the drive shaft when the tightening bolts are tightened.

In embodiments, the mechanism can include stainless steel or titanium.

In embodiments, the mechanism can include coatings configured to minimize corrosion due to salt water.

In embodiments, the mechanism can include dimensions such as circular sections with diameters of about 3.15 mm to about 3.20 mm.

In embodiments, the mechanism can include dimensions such as body widths of about 11.4 mm.

In embodiments, the mechanism can include dimensions such as inner diameters of about 29 mm.

In embodiments, the mechanism can include dimensions such as effective outside diameter of the integral positioning ring of about 33 mm.

In embodiments, the mechanism can include dimensions such as an outside diameter of the mechanism of about 40 mm.

In embodiments, the mechanism can include inner diameters of about 28 mm to about 29 mm.

In embodiments, the mechanism can include inner diameters of about 15 mm to about 35 mm.

In embodiments, the mechanism can include dimensions such as body heights of about 6 mm to about 12 mm.

These and other objects, features, and advantages of the present invention will become more readily apparent from the attached drawings and the detailed description of the preferred embodiments, which follow.

BRIEF DESCRIPTION OF THE DRAWINGS

The features and advantages of the present invention will be better understood when the Detailed Description of the Preferred Embodiments given below is considered in conjunction with the figures provided.

DETAILED DESCRIPTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art.

Figure 1:
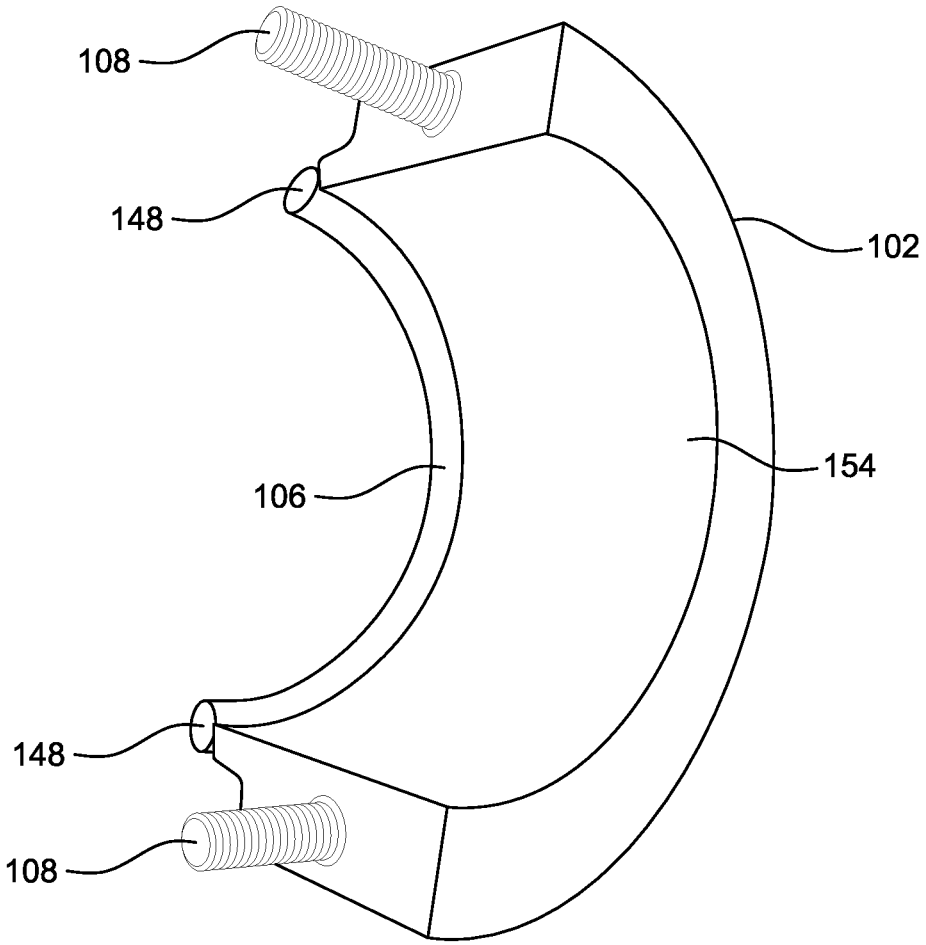
FIG. 1 is an internal view of a male portion of a clamping mechanism in an embodiment of the present invention.

FIG. 1 shows an internal view of an embodiment of a clamping mechanism 104. The mechanism 104 includes a male portion 102 of the clamping mechanism 104. The clamping mechanism includes an integral positioning ring 106. The clamping mechanism 104 also includes fastening bolts 108 to attach the male portion 102 of the clamping mechanism 104 to a female portion 110. As seen in FIG. 1, the male portion 102 of the clamping mechanism 104 includes an interior surface 154 designed to grip onto the external surface of a drive shaft 202 (as shown in FIG. 4) when the clamping mechanism's 104 tightening bolts 108 join both the male and female portions 102 and 110 when assembled onto the drive shaft 202.

Figure 2:
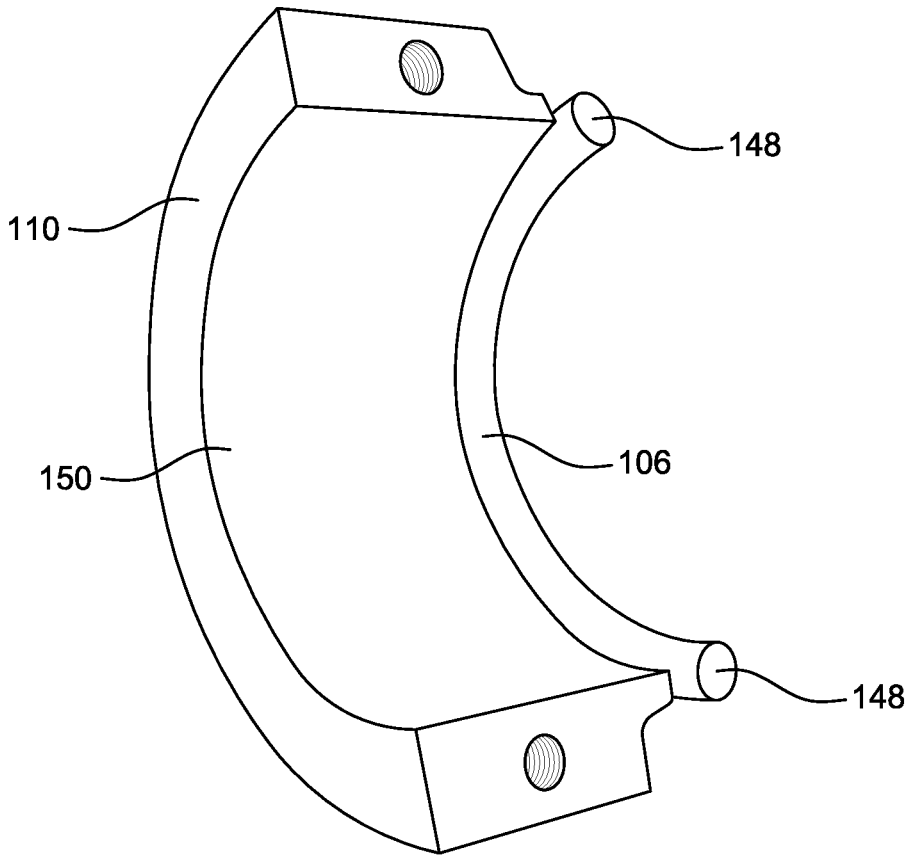
FIG. 2 is an internal view of a female portion of a clamping mechanism in an embodiment of the present invention.

FIG. 2 shows an internal view of the female portion 110 of the clamping mechanism 104. The female portion 110 also includes an integral positioning ring 106. the female portion 110 of the clamping mechanism 104 includes an interior surface 150 designed to grip onto the external surface of a drive shaft 202 (as shown in FIG. 4) when the clamping mechanism's 104 tightening bolts 108 join both the male and female portions 102 and 110 when assembled onto the drive shaft 202.

Figure 3:
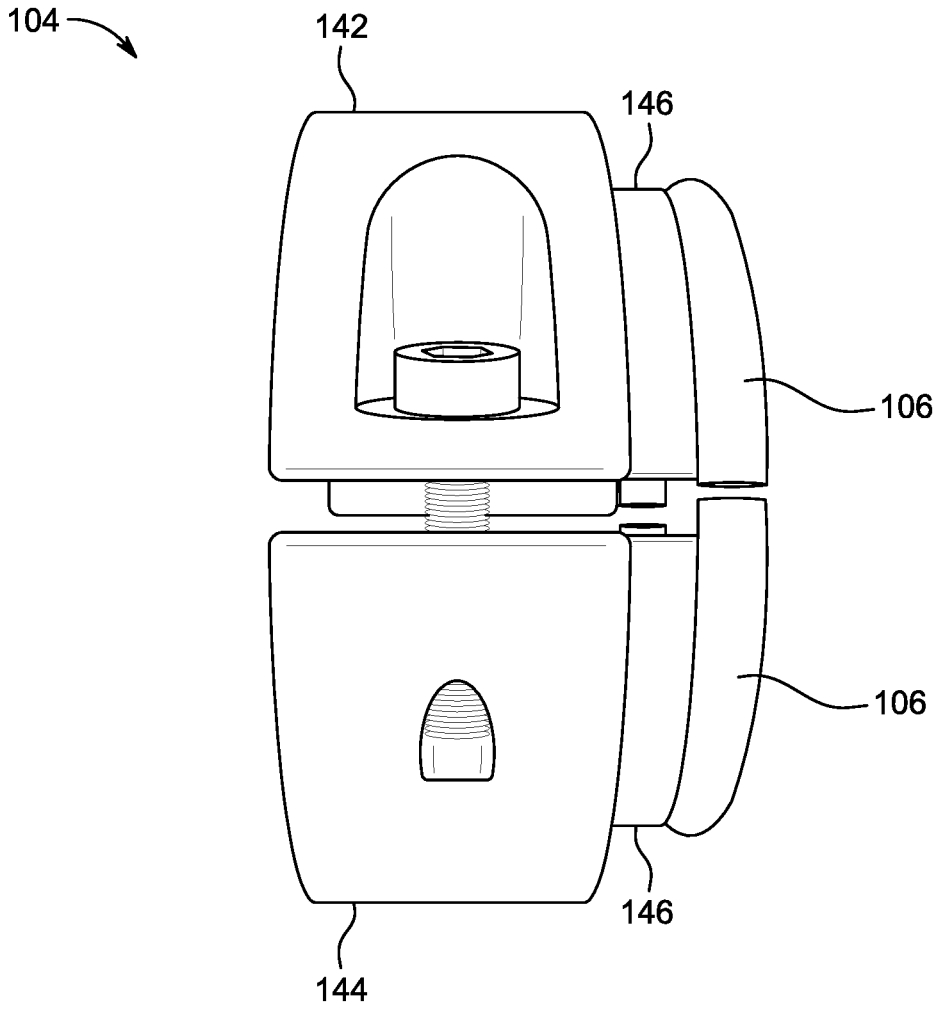
FIG. 3 shows a side view of an assembled clamping mechanism in an embodiment of the present invention.

FIG. 3 presents a view of an assembled clamping mechanism 104. When the fastening bolts 108 tighten the male 102 and female 110 portions their respective integral positioning ring 106 form a 360-degree integral positioning ring 106 designed to securely fit into the positioning groove 206 (as shown in FIG. 4) of the drive shaft 202 as well as to provide a backstop to the support ring 204 (as shown in FIG. 4). The clamping mechanism 104 can include a male clamping body 142 and a female clamping body 144. Both clamping bodies 142 and 144 connect to a 180-degree portion of an integral positioning ring 106 by a connecting span 146. The connecting span 146 connects the clamping bodies 142 and 144 to integral positioning ring 106. When assembled and placed in position on the drive shaft 202, the clamping mechanism 104 forms an inner diameter that fits securely to the outer diameter of the drive shaft 202. Both the inner diameters of the clamping bodies 142 and 144 and the connecting span 146 are identical and together provide an augmented surface area onto which the clamping mechanism 104 and the drive shaft 202 share thereby providing for an increased and augmented positioning of the support ring 204 onto the drive shaft 202.

Figure 4:
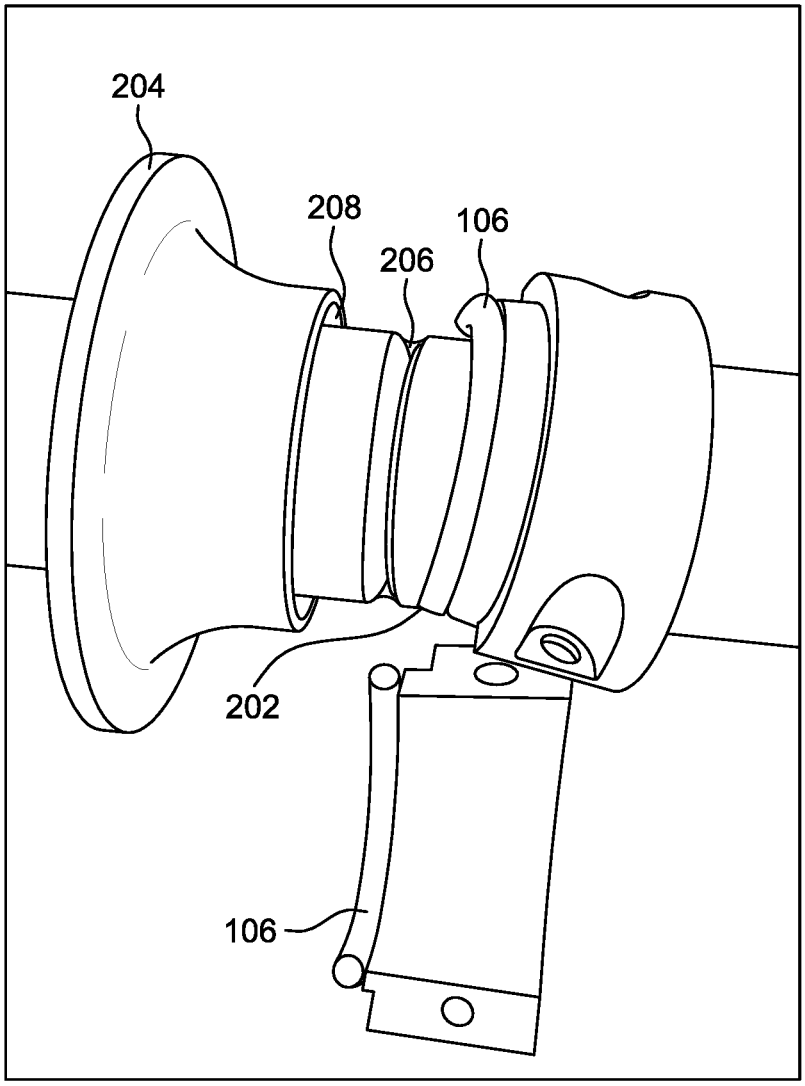
FIG. 4 shows a top perspective view of a clamping mechanism being placed into position onto a shaft in an embodiment of the present invention.

FIG. 4 is a top perspective view of the clamping mechanism 104 being assembled onto the drive shaft 202. As seen in FIG. 4, the clamping mechanism 104 is assembled onto the drive shaft 202 and when the integral positioning ring 106 is placed in the positioning groove 206 of the drive shaft 202, the support ring 204 and then secured in place by movement of the support ring 204 until an inner groove 208 of the support ring abuts against an outer surface of the integral positioning ring 106.

Figure 5:
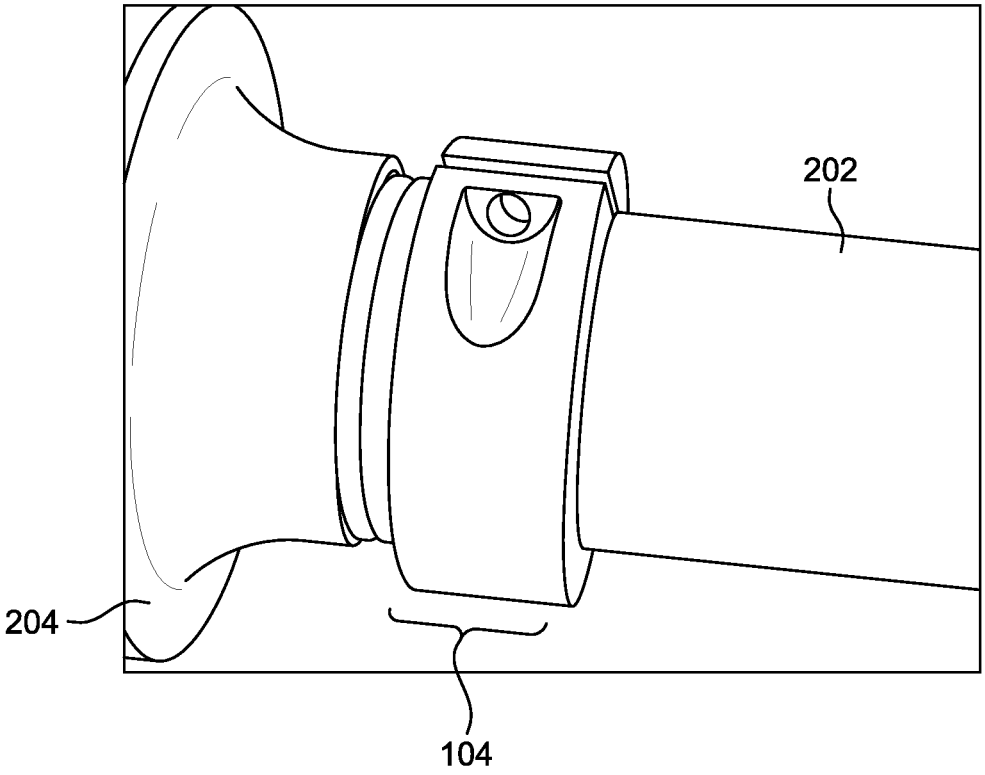
FIG. 5 shows a top perspective view of an installed clamping mechanism on a shaft with the support ring prepared to lock onto the clamping mechanism.

FIG. 5 is a side perspective view of the clamping mechanism 104 assembled onto the drive shaft 202 and axially aligning the support ring 204 to the drive shaft 202.

Figure 6:
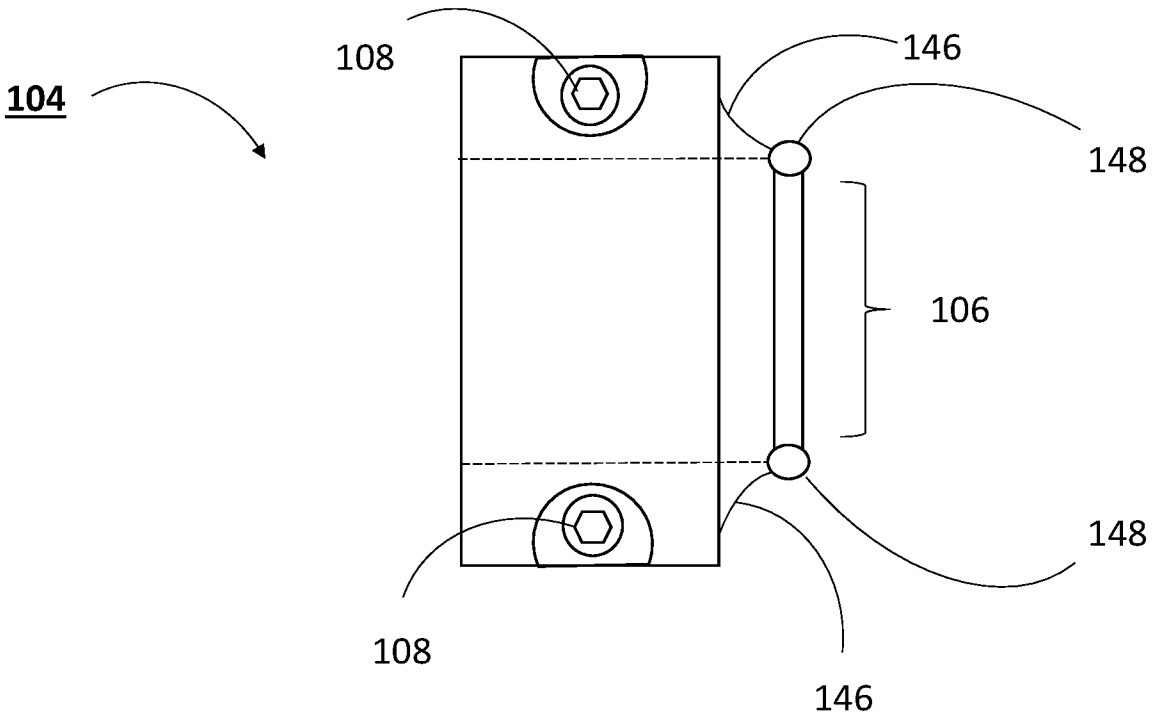
FIG. 6 shows a side view of a male portion of a clamping mechanism in an assembled fashion.

FIG. 6 is a side view of the clamping mechanism 104 showing the male portion 102. As best seen in FIG. 6, the integral positioning ring includes a circular cross section 148 and the three-dimensional shape of the integral positioning ring 106 is a circular toroid such that the integral positioning ring 106 resembles a large doughnut. the effective diameter of the circular sections 148 of the integral positioning ring 106 is such that the surfaces of the ring allow both engagement with the positioning groove 206 on the drive shaft 202 and as a backstop to the support ring 204 by engagement with the inner groove 206 of the support ring 204.

Figure 7:
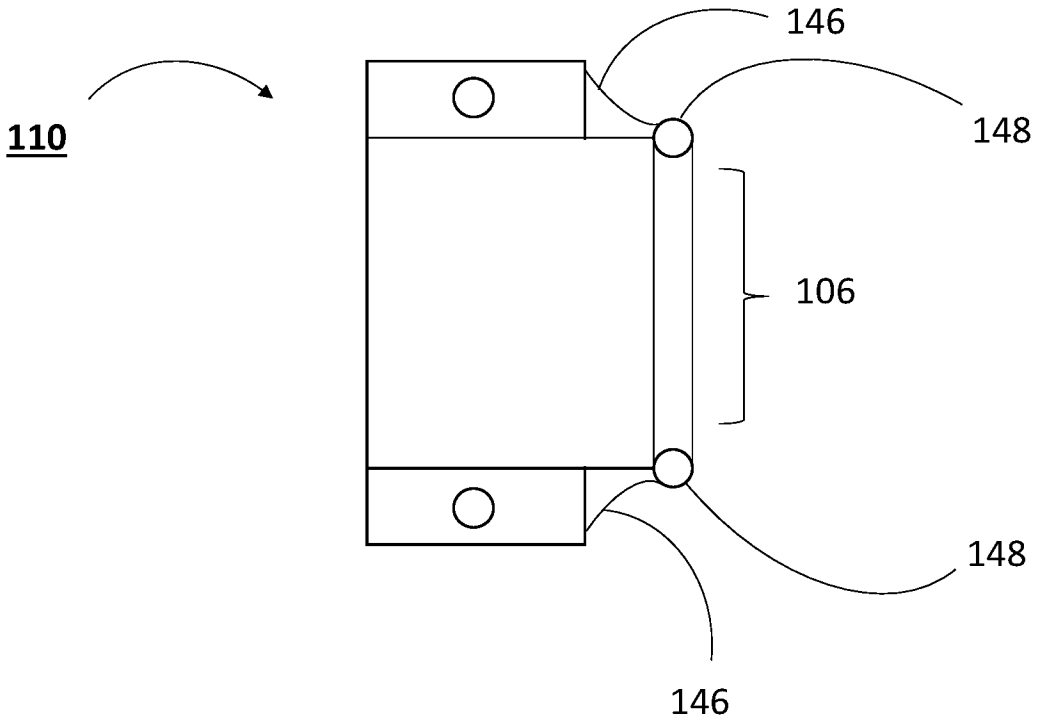
FIG. 7 shows a side view of an internal side of a female portion of a clamping mechanism.

FIG. 7 displays a side view of the internal surface of the female portion 110 of the clamping mechanism 104 and also shows the placement of the integral positioning ring's 106 circular cross section 148 to allow engagement with both the positioning groove 206 of the support ring 204 and to act as a backstop to the support ring 204 using the inner groove 206 of the support ring 204. The circular shape 148 of the integral positioning ring 106 is such that the inner portion of the circular shape 148 engages with the positioning groove 206 of the drive shaft 202 and the outer portion of the circular shape 148 engages with an inner groove 206 on the support ring 204 and provides a backstop to the support ring 204 and ensures accurate axial positioning on the drive shaft 202.

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

The present invention has been described with reference to the preferred embodiments, it should be noted and understood that various modifications and variations can be crafted by those skilled in the art without departing from the scope and spirit of the invention. Accordingly, the foregoing disclosure should be interpreted as illustrative only and is not to be interpreted in a limiting sense. Further it is intended that any other embodiments of the present invention that result from any changes in application or method of use or operation, method of implementation which are not specified within the detailed written description or illustrations contained herein are considered within the scope of the present invention.

Insofar as the description above and the accompanying drawings disclose any additional subject matter that is not within the scope of the claims below, the inventions are not dedicated to the public and the right to file one or more applications to claim such additional inventions is reserved.

Although very narrow claims are presented herein, it should be recognized the scope of this invention is much broader than presented by the claims. It is intended that broader claims will be submitted in an application that claims the benefit of priority from this application.

What is claimed is:

1. A clamping mechanism suitable for use as an integral personal watercraft shaft sealing axial alignment system comprising:

a male clamping body;

a female clamping body configured to mate with the male clamping body;

tightening bolts structured to connect the male clamping body to the female clamping body;

connecting spans connected to the male clamping body and the female clamping body;

integral positioning ring halves connected to the male clamping body and the female clamping body with the connecting spans, wherein the integral positioning ring halves form a circular toroid when the male clamping body and the female clamping body are connected and assembled and wherein a radius of the circular toroid cross section is designed to fit into a positioning groove of a drive shaft and to provide axial positioning for the circular toroid and acts as a backstop to a support ring; and wherein the connecting spans, the male clamping body, and the female clamping body have inner diameters that are identical and are arranged to securely fit onto an outer surface of the drive shaft when the tightening bolts are tightened.

2. The clamping mechanism as recited in claim 1 further comprising stainless steel or titanium.

3. The clamping mechanism as recited in claim 1 further comprising inner diameters of about 29 mm.

4. The clamping mechanism as recited in claim 1 further comprising an effective outside diameter of the integral positioning ring of about 33 mm.

5. The clamping mechanism as recited in claim 1 further comprising an outside diameter of the mechanism of about 40 mm.

6. The clamping mechanism as recited in claim 1 further comprising circular sections with diameters of about 3.15 to about 3.20 mm.

7. The clamping mechanism as recited in claim 1 further comprising body widths of about 11.4 mm.

8. The clamping mechanism as recited in claim 1 further comprising inner diameters of about 28 mm to about 29 mm.

9. The clamping mechanism as recited in claim 1 further comprising inner diameters of about 15 mm to about 35 mm.

10. The clamping mechanism as recited in claim 1 further comprising body heights of about 6 mm to about 12 mm.

* * * * *